US007815081B2

(12) United States Patent
Gist et al.

(10) Patent No.: US 7,815,081 B2
(45) Date of Patent: Oct. 19, 2010

(54) RETRACTABLE BELT CLIP FOR HAND-HELD TOOL

(75) Inventors: Daily Gist, Huntersville, NC (US); Derek J. Nash, Huntersville, NC (US); Raymond Chan, Hong Kong (CN)

(73) Assignee: Irwin Industrial Tool Company, Huntersville, NC (US)

( * ) Notice: Subject to any disclaimer, the term of this patent is extended or adjusted under 35 U.S.C. 154(b) by 1398 days.

(21) Appl. No.: 11/186,364

(22) Filed: Jul. 21, 2005

(65) Prior Publication Data

US 2006/0113985 A1 Jun. 1, 2006

Related U.S. Application Data

(60) Provisional application No. 60/590,002, filed on Jul. 21, 2004.

(51) Int. Cl.
*A45F 5/00* (2006.01)
*A45F 3/00* (2006.01)
*A45C 1/04* (2006.01)

(52) U.S. Cl. ..... 224/269; 224/268; 224/666; 224/667; 224/668

(58) Field of Classification Search ..... 224/268, 224/269, 666, 667, 930, 271, 668; 324/67; 33/286, 290; 220/345.2, 345, 345.4
See application file for complete search history.

(56) References Cited

U.S. PATENT DOCUMENTS 2,866,215 A * 12/1958 Scully ..... 15/145
3,434,638 A * 3/1969 Beynon ..... 224/197
3,627,177 A * 12/1971 Marcus et al. ..... 222/181.3
3,768,684 A * 10/1973 Buchtel ..... 215/399
3,883,024 A * 5/1975 Thomas ..... 215/399
3,998,360 A * 12/1976 Mack ..... 222/181.1
4,101,043 A * 7/1978 Johnson et al. ..... 215/399
4,678,102 A * 7/1987 Ryder ..... 222/181.3
5,280,635 A * 1/1994 Knoedler et al. ..... 455/128
5,551,095 A * 9/1996 Chen ..... 4/227.3
6,321,622 B1 * 11/2001 Tsuge et al. ..... 81/57.4
6,905,052 B2 * 6/2005 Sakai et al. ..... 224/269
7,010,331 B2 * 3/2006 Johnson et al. ..... 455/575.1
7,063,244 B2 * 6/2006 Lee et al. ..... 224/271
7,100,293 B2 * 9/2006 Kahle ..... 33/290
2004/0239914 A1 * 12/2004 Stierle et al. ..... 356/4.01

FOREIGN PATENT DOCUMENTS

DE 4310602 C1 * 5/1994
DE 29723296 U1 * 10/1998

* cited by examiner

*Primary Examiner*—Nathan J Newhouse
*Assistant Examiner*—Lester L Vanterpool
(74) *Attorney, Agent, or Firm*—Dennis J. Williamson; Moore & Van Allen, PLLC

(57) ABSTRACT

A retractable belt clip is disposed on an electronic hand-held tool, such as a stud finder, a laser level, or an electronic tape measure, and is moveable from a stowed position, in which the belt clip is disposed within or flush to a housing of the tool, to a deployed position, in which the belt clip may be attached to a belt or other member for carrying and storage.

7 Claims, 4 Drawing Sheets

RETRACTABLE BELT CLIP FOR HAND-HELD TOOL

TECHNICAL FIELD

This disclosure relates generally to hand-held tools such as stud finders, laser generating devices, measuring tapes, etc. and more specifically to a retractable belt clip to be used on a hand-held tool.

BACKGROUND

Handheld tools, and in particular, electronic handheld tools, come in many varieties, sizes, and shapes. There are, for example, hand-held electronic stud finders, hand-held electronic tape measures, such as sonic tape measures, hand-held laser pointers, laser line generators, laser levels, etc., all of which have been developed to aid a builder, a home repair person, or other person in the process of constructing buildings, walls, etc. or in the process of hanging pictures, shelves, etc. on already existing structures.

It is generally known to provide such hand-held devices with a belt clip to aid the user in storing the device on his or her body when not in use. However, such belt clips typically extend out from the housing of the hand-held tool in order to provide a space between the tool housing and the belt clip to be used to attach the tool to a belt or other support structure for storage and carrying. These known belt clips therefore produce a tool having an uneven surface that may not be desirable from a utilitarian standpoint, such as when it is desirable to have the tool sit level on a surface such as a table for making measurements, or when it is desirable for the tool to take up minimal amount of space in a storage container, such as a tool box or a drawer. In addition, the belt clip can interfere with the operation of electronic handheld devices, such as those that include buttons and/or switches or those that need to be placed flush against a wall or other surface during use.

SUMMARY OF THE DISCLOSURE

An improved hand-held electronic tool is provided with a retractable belt clip that may be extended from a housing of the tool to allow the user to hang the tool on a standard belt or other support structure. The retractable belt clip may also be retracted into the tool so that the belt clip is flush with or disposed within the housing of the tool when the belt clip is not in use. This retracted position helps eliminate uneven surfaces and the like caused by prior art belt clips during use of the hand-held tool.

Other features and advantages of the disclosed devices and methods will be apparent to those of ordinary skill in the art in view of the detailed description provided below, which is made with reference to the attached drawings provided in illustration of one preferred embodiment.

DETAILED DESCRIPTION

Figure 1:
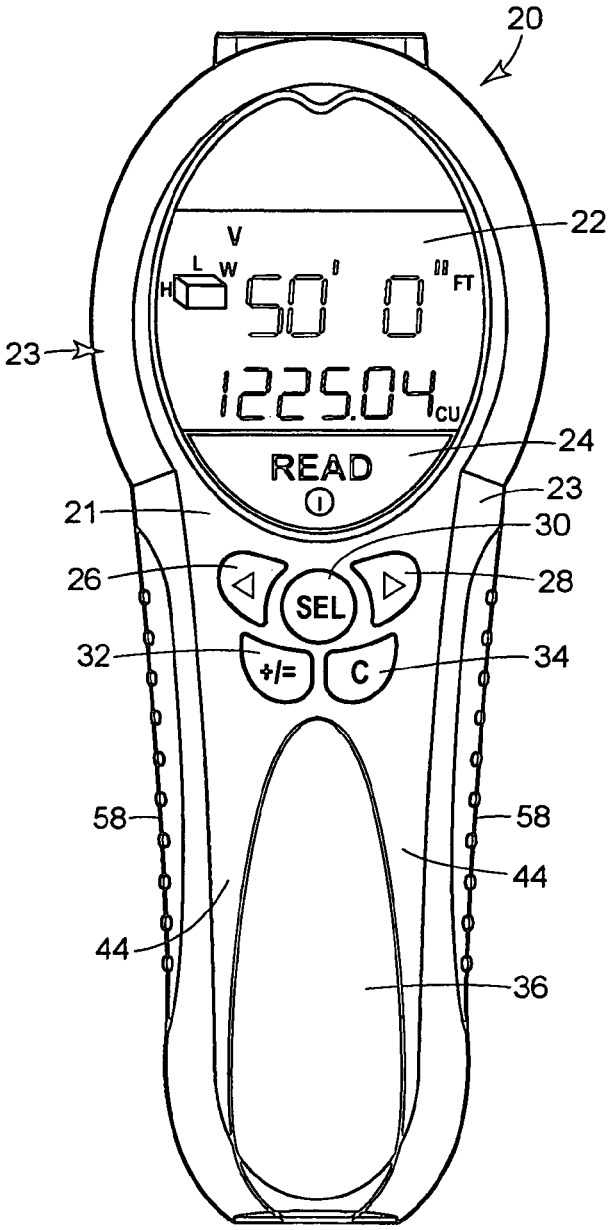
FIG. 1 is a plan view of a hand-held electronic tool in the form of an electronic tape measure that includes a sonic measuring device and has a retractable belt clip member disposed thereon.

With reference initially to FIG. 1, a hand-held electronic tool 20 in the form of an electronic tape measure includes a microprocessor (not shown), a memory (not shown), and an electronic display 22 in the form of an LCD (liquid crystal display) disposed on a user interface side 21 of a housing 23. Input mechanisms in the form of a power/read button 24, a first scroll button 26, a second scroll button 28, a select button 30, an addition button 32, and a clear button 34 are also illustrated as being disposed on the user interface side of the housing 23 and are electronically connected to the microprocessor within the housing 23 to perform electronic measuring and display functions. Of course, any other buttons and any other type of display could be used instead of or in addition to those illustrated in FIG. 1. The hand-held electronic tool 20 may include any known or standard circuitry for measuring distances from the electronic tape measure 20, such as any known sonic or laser measuring circuitry. Furthermore, while the hand held-electronic tool 20 is illustrated as an electronic tape measuring device, the hand-held electronic tool 20 could be any other desired type of tool, including, for example, a stud finder, a laser level, a laser line generating device, etc. In these cases, standard or typical circuitry and components could be used to perform the primary function of the tool, such as locating studs or other obstructions, generating laser lines, etc.

Figure 5:
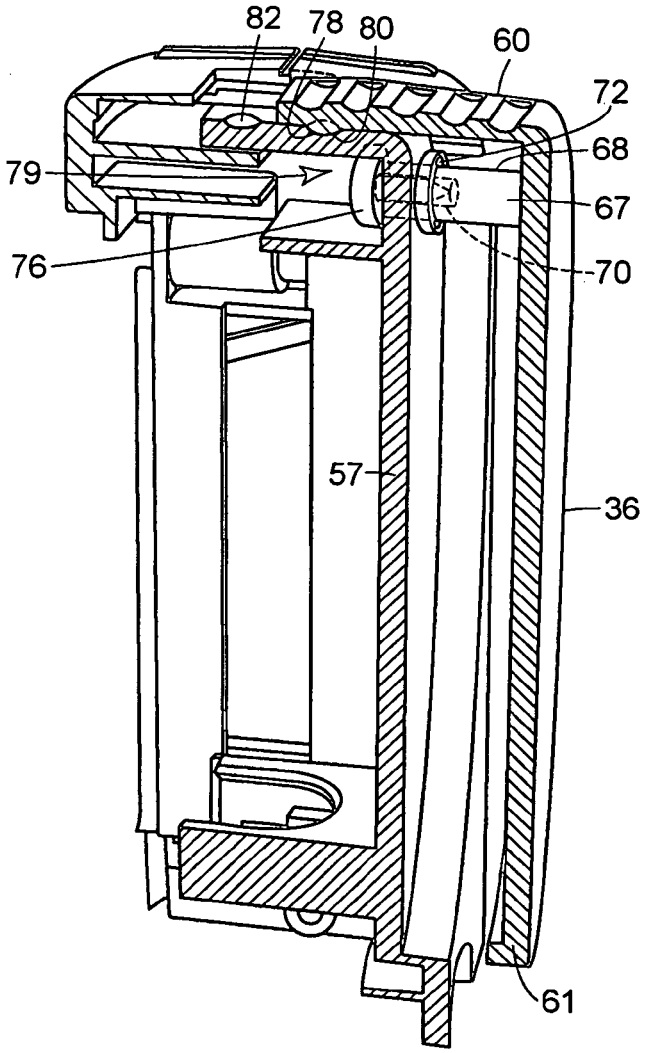
FIG. 5 is a cut-away view of a portion of the hand-held electronic tool showing a deployment and retraction mechanism associated with the retractable belt clip member.

The hand-held electronic tool 20 includes a retractable belt clip member 36, only the top of which is shown in FIG. 1. As illustrated in FIG. 5, a front housing portion 57 of the housing 23 accepts the retractable belt clip member 36 therein so that, when in a retracted position, an upper side of the retractable belt clip member 36 is disposed within a recess 40 (see FIG. 3) so that the outer surface of the clip member 36 forms a continuous smooth surface with the adjacent portions 44 of the housing.

Figure 2:
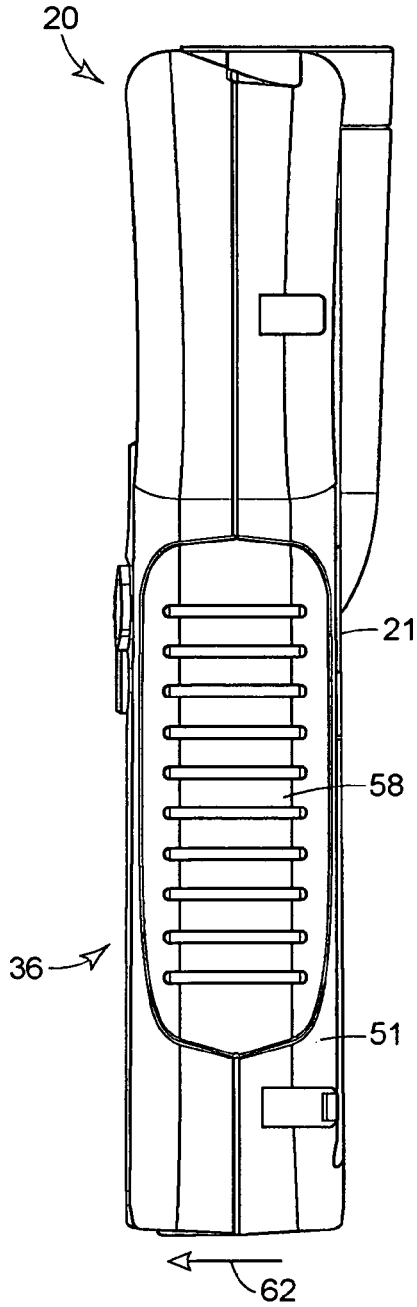
FIG. 2 is an elevational view of the hand-held electronic tool of FIG. 1.

FIG. 2 also illustrates a ribbed side grip panel 58 disposed on the outside of the front housing portion 57 (a similar grip panel 58 is disposed on the other side of the housing 23). The ribbed side grip panels 58 provide for ease in holding and using the tool 20.

Figure 3:
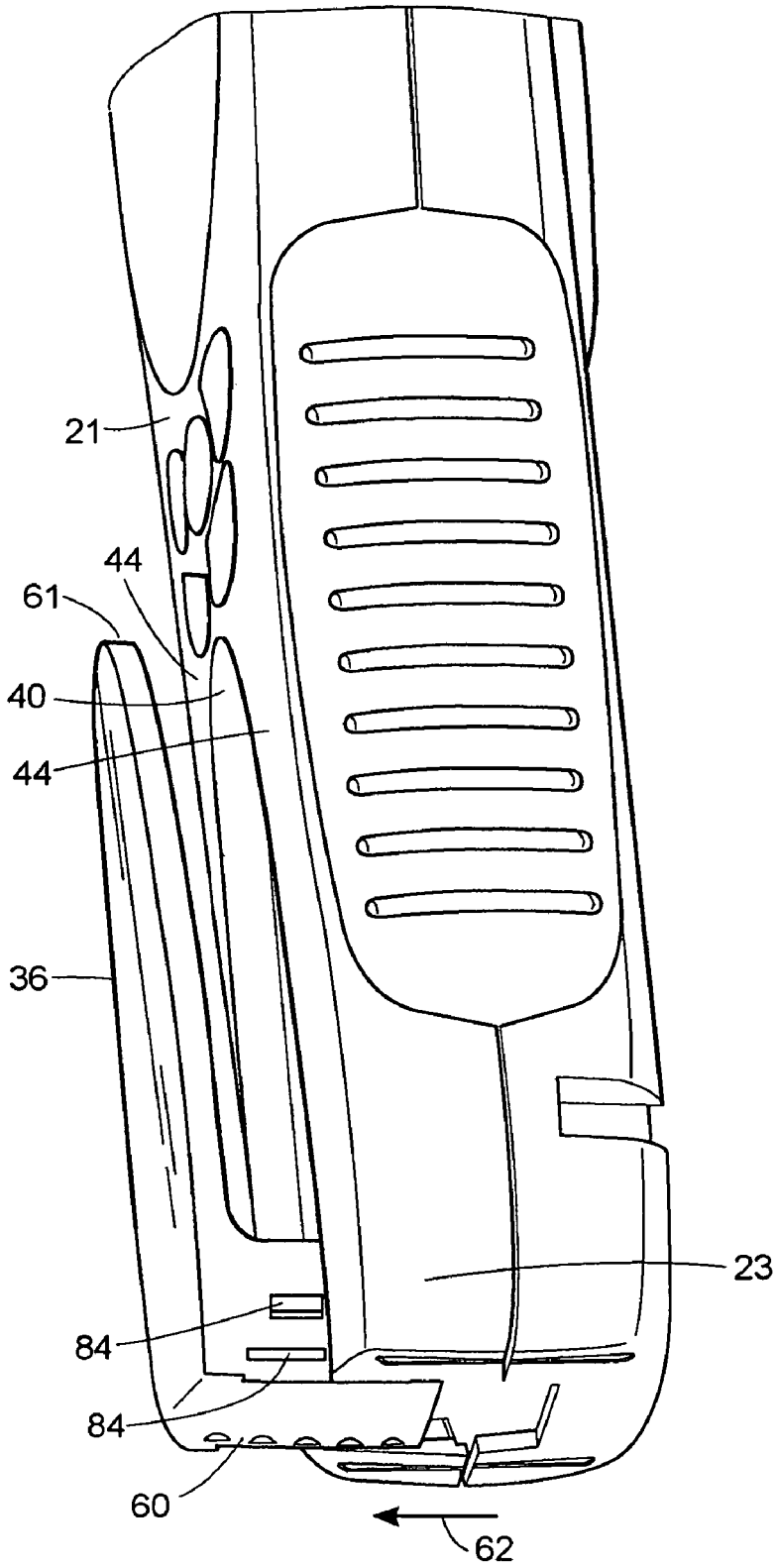
FIG. 3 is a perspective view of a portion of the hand-held electronic tool of FIG. 1 illustrating the retractable belt clip member in a deployed configuration.
Figure 4:
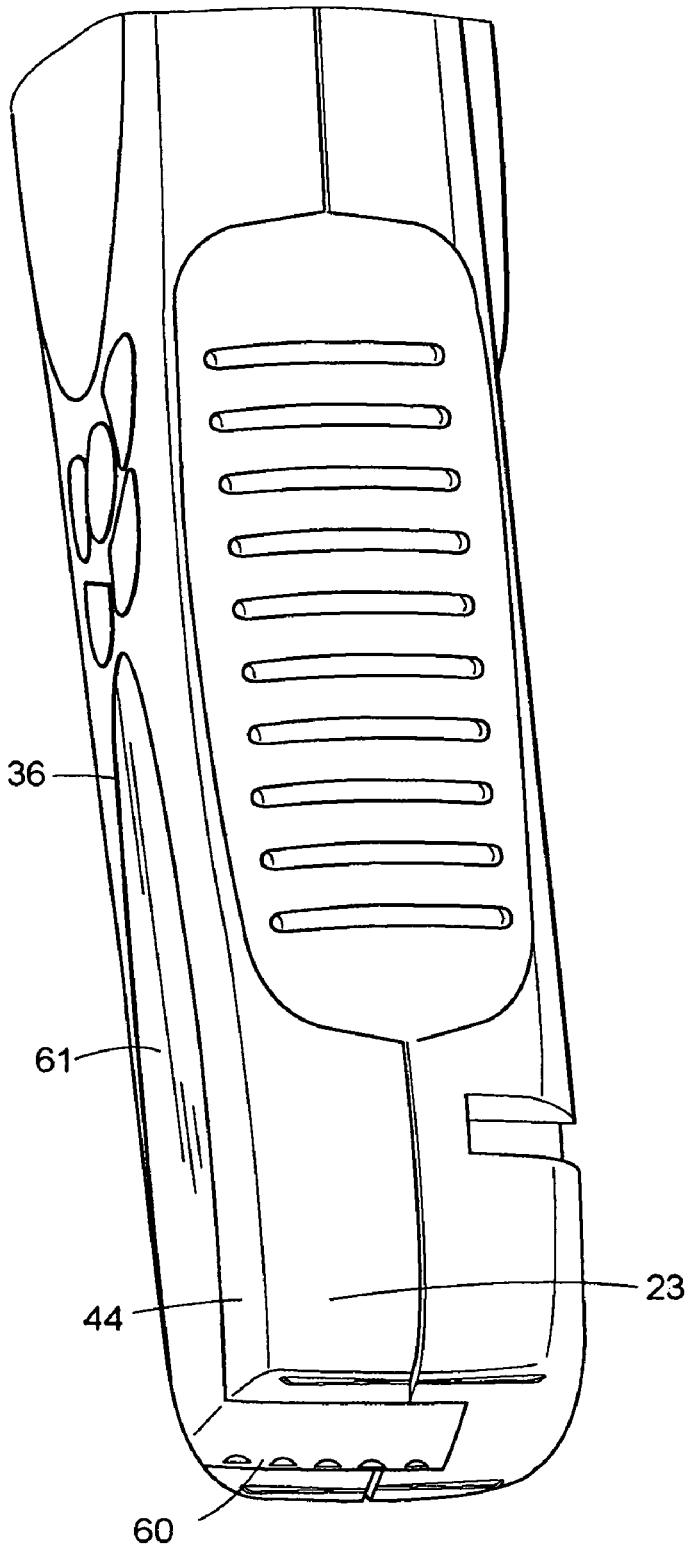
FIG. 4 is a perspective view of a portion of the hand-held electronic tool of FIG. 1 showing the retractable belt clip member in a stowed configuration.

FIG. 3 illustrates a perspective view of the housing 23 of the tool 20 in which the retractable belt clip member 36 is disposed in a deployed configuration, while FIG. 4 illustrates a perspective view of the housing 23 with the retractable belt clip member 36 in a stowed configuration. As shown in FIG. 3, the retractable belt clip member 36 may include a ribbed base surface 60 coupled to a clasp member 61, wherein the ribbed base surface 60 is accessible from a different side of the housing (the bottom, rather than the front) and may be used to facilitate deployment and retraction of the clasp member 61 by sliding the clasp member with respect to the housing 23 along the line of the directional arrow 62 (shown in FIGS. 2 and 3).

When in the deployed position of FIG. 3, the clasp member 61 is disposed away from the housing 23 so that a space exists between the clasp member 61 and the housing 23. As will be understood, a belt or other thin support structure (not shown) may be disposed between the clasp member 61 and the housing 23 when the belt clip member 36 is in the deployed position to carry or otherwise support the tool 20 in a hanging manner. As shown in FIG. 4, when the belt clip member 36 is in the retracted or stowed position, the clasp member 61 has an upper surface that is flush with or disposed within the housing 23 providing a clean or smooth surface to the housing 23 in the area of the clasp member 61.

Figure 6:
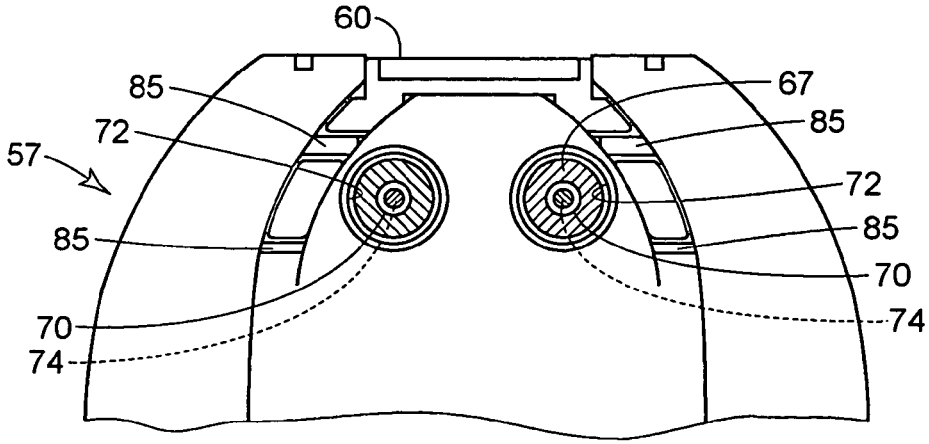
FIG. 6 is a cross-sectional cut-away view of the hand-held electronic tool illustrating the deployment and retraction mechanism in more detail.

FIGS. 5 and 6 are cross-sectional views illustrating further details of the structure that allows deployment and retraction of the retractable belt clip member 36. Referring to FIG. 5, the belt clip member 36 includes two bosses 68 (only one of which is visible in FIG. 5), each of which includes a blind hole 70. As shown best in FIG. 6, the front housing portion 57 includes a pair of openings 72 through which the shafts 67 of the bosses 68 pass. Referring again to FIG. 5, a threaded fastener 74 is threadably secured to each of the blind holes 70, and includes a fastener head 76 that prevents the retractable clip member 36 from being completely removed from connection to the front housing portion 57. However, the bosses 68 and the fastener 74 are able to move or slide within a space 79 to enable the clip member 36 to move between the stowed and the deployed positions.

A detent protrusion 78 may be provided on the retractable belt clip member 36, such that the protrusion 78 mates with a corresponding deployed detent dimple 80 formed in the front housing portion 57 when the clip member 36 is in the deployed position. The detent protrusion 78 also mates with a stowed detent dimple 82 (also formed in the front housing portion 57) when the clip member 36 is in the stowed position. These cooperating detent elements help to hold the clip member 36 in each of the stowed and deployed positions and also to provide a satisfactory feel to the user when moving the clip member 36 between the stowed and deployed positions, or vice-versa.

Also, as seen best in FIG. 3, guide slots 84 may be formed in the belt clip member 36 and may slidably accept ribs or protrusions 85 (FIG. 6) extending from an interior side of the housing 23. (The positioning of these sliding elements can also be reversed.) The illustrated guide slots have an elongated length that extends obliquely with respect to the user interface side 21 of the housing, from which the clip extends. Such sliding elements help to ensure that the belt clip member 36 will move from the stowed configuration to the deployed configuration and vice-versa in a linear fashion, and can also help to stabilize the belt clip member 36 in a proper position with respect to the housing 23.

The housing 23 may be made from any suitable material, such as ABS plastic, and the retractable belt clip member 36 and side grip panels 58 may also be made from any suitable material, such as ABS plastic. The buttons 24-34 may be made from any suitable material such as a TPR rubber material.

Due to the retractable nature of the belt clip member 36, a belt clip can be provided on the front of the tool 20 without interfering with operation of the buttons 24-34 during use of the tool 20. Because the belt clip member 36 is retractable, it may also be located on the front or back of the tool 20 without interfering with the operation of the tool 20. Of course, if desired, the belt clip member 36 and associated structure could be located at any other desired position on the housing 23. In any event, the belt clip member 36 may be deployed when it is desired to hang the tool on, for example, a belt, and may be stowed during use of the tool 20 or during storage of the tool 20 in a manner other than hanging the tool 20 from a support structure.

The foregoing detailed description has been given for clearness of understanding only and no unnecessary limitations should be understood therefrom, as modifications will be obvious to those skilled in the art. For example, the teachings of this disclosure are applicable to many types of handheld devices in addition to length measuring devices, such as, for example, laser levels, and stud sensors.

The invention claimed is:

1. A handheld tool comprising:

a housing having a side and containing mechanical or electrical components for performing a function of the tool; and a belt clip extending from the side of the housing that is movable between a deployed position in which a portion of the belt clip is disposed away from the housing and extends generally parallel to said side such that a space is created between the housing and the belt clip adapted to receive a belt and a stowed position in which the belt clip is disposed flush with or within the housing;

the housing having an opening;

a shaft that is connected to the clip being slidably mounted within the opening, permitting limited movement of the clip with respect to the housing along the axis of the shaft;

a head on the shaft preventing the clip from being completely removed from the housing;

sliding elements comprising a guide slot that slides with respect to a protrusion, at least one of the guide slot or protrusion being on the housing and the other of the guide slot or protrusion being on the clip, and at least one of the sliding elements having an elongated dimension that extends obliquely with respect to the side of the housing; and cooperating detent elements that include a detent protrusion and a detent dimple that resist movement of the clip when the detent dimple engages the detent protrusion, one of the detent protrusion or detent dimple being on the housing and the other of the detent protrusion or detent dimple being on the clip.

2. The tool recited in claim 1, wherein the housing has a recess that is bounded by adjacent portions of the housing; and the belt clip has an outer surface that forms a continuous smooth surface with the adjacent portions of the housing when the clip is in the stowed position.

3. The tool as recited in claim 1, wherein the clip has a base surface that is accessible from another side of the housing.

4. The tool as recited in claim 1, wherein the clip has a ribbed base surface that is accessible from another side of the housing.

5. The tool as recited in claim 1, wherein the tool is within the group of handheld electronic tools that includes stud finders, laser levels, and laser line generating devices.

6. The tool as recited in claim 1, wherein the tool has a user interface side of the housing that includes buttons or an electronic display, and the clip extends from the user interface side of the housing.

7. The tool as recited in claim 1 wherein the cooperating detent elements include a plurality of detent dimples located on one of the housing or clip and a detent protrusion located on the other one of the housing or clip, the detent protrusion engaging one of the plurality of detent dimples when the clip is in the deployed position and another one of the plurality of detent dimples when the clip is in the stored position.

* * * * *